US012279680B2

(12) United States Patent
Cluzeau

(10) Patent No.: US 12,279,680 B2
(45) Date of Patent: Apr. 22, 2025

(54) LINK CHAIN OF AN ARTICLE OF JEWELLERY AND/OR GEMSTONE JEWELLERY AND ARTICLE OF JEWELLERY AND/OR GEMSTONE JEWELLERY COMPRISING SUCH A LINK CHAIN

(71) Applicant: HERMES SELLIER, Paris (FR)

(72) Inventor: David Cluzeau, Charenton le Pont (FR)

(73) Assignee: HERMES SELLIER, Paris (FR)

( * ) Notice: Subject to any disclaimer, the term of this patent is extended or adjusted under 35 U.S.C. 154(b) by 0 days.

(21) Appl. No.: 18/347,357

(22) Filed: Jul. 5, 2023

(65) Prior Publication Data

US 2024/0008599 A1 Jan. 11, 2024

(30) Foreign Application Priority Data

Jul. 6, 2022 (FR) ..... 2206896

(51) Int. Cl.
*A44C 5/10* (2006.01)
*A44C 5/02* (2006.01)
*A44C 17/02* (2006.01)

(52) U.S. Cl.
CPC ..... *A44C 5/02* (2013.01); *A44C 17/02* (2013.01)

(58) Field of Classification Search
CPC ..... A44C 5/102; A44C 5/02; A44C 17/02
See application file for complete search history.

(56) References Cited

U.S. PATENT DOCUMENTS

| | | | | |
|---|---|---|---|---|
| 10,271,619 | B1 * | 4/2019 | Peck | A44C 5/08 |
| 10,306,957 | B2 * | 6/2019 | Scandolaro | A44C 5/025 |
| 11,064,776 | B2 * | 7/2021 | Ostasz | A44C 9/02 |
| 11,116,292 | B2 * | 9/2021 | Demeglio | A44C 11/007 |
| 2008/0314080 | A1 | 12/2008 | Perle | |

FOREIGN PATENT DOCUMENTS

| | | | |
|---|---|---|---|
| KR | 20120097442 | A | 9/2012 |
| WO | 0038551 | A1 | 7/2000 |
| WO | 2019186423 | A1 | 10/2019 |

OTHER PUBLICATIONS

French Search Report for FR 2206896 dated Jan. 31, 2023, 7 pages.

* cited by examiner

*Primary Examiner* — Jack W Lavinder
(74) *Attorney, Agent, or Firm* — NIXON & VANDERHYE

(57) ABSTRACT

A link chain of an article of jewelry and/or gemstone jewelry includes first and second links mechanically secured to one another and each including an ornamental element, a cradle configured to receive the ornamental element in an internal space and including a slot formed at a first end of the cradle and leading into the internal space, and an assembly head extending such that it projects from a second end of the cradle outside the internal space of the cradle; with the link chain being formed by the insertion of the head of the first link into the internal space of the second link through the slot thereof and by the ornamental element which comes to face the head of the first link and which is set in the internal space of the second link.

20 Claims, 4 Drawing Sheets

LINK CHAIN OF AN ARTICLE OF JEWELLERY AND/OR GEMSTONE JEWELLERY AND ARTICLE OF JEWELLERY AND/OR GEMSTONE JEWELLERY COMPRISING SUCH A LINK CHAIN

CROSS-REFERENCE TO RELATED APPLICATION

This application claims priority to FR 2206896 filed Jul. 6, 2022, the entire contents of which are hereby incorporated by reference.

TECHNICAL FIELD OF THE INVENTION

The present invention relates to a link chain of an article of jewellery and/or gemstone jewellery.

The invention further relates to an article of jewellery and/or gemstone jewellery comprising such a link chain, in particular to form a fringe.

The invention further relates to a method for manufacturing a link chain, in particular to form a fringe of an article of jewellery and/or gemstone jewellery.

PRIOR ART

Articles of jewellery and/or gemstone jewellery of the chain type are known and include a link chain formed by a plurality of links, each link being engaged with another link. This can involve, for example, rings interlocked and welded together, or connected to one another by hinge-type interface elements and which include, for example, connecting pins or pegs.

SUMMARY OF THE INVENTION

The purpose of the invention is to provide a link chain for an article of jewellery and/or gemstone jewellery, which link chain is particularly simple and convenient, in particular in terms of assembly.

According to a first aspect, the invention thus relates to a link chain for an article of jewellery and/or gemstone jewellery, comprising at least one first link and at least one second link mechanically secured to the at least one first link, each of the at least one first link and at least one second link includes an ornamental element and a cradle configured to receive the ornamental element in an internal receiving space of the cradle and including an assembly slot formed at a first end of the cradle and leading into the internal space, and an assembly head extending such that it projects from a second end of the cradle, opposite the first end thereof, and outside the internal space of the cradle; with the link chain being formed by the at least partial insertion of the assembly head of the at least one first link into the internal space of the cradle of the at least one second link through the assembly slot thereof and by the ornamental element which comes to face the assembly head of the at least one first link and which is set in the internal space of the cradle of the at least one second link.

In the link chain according to the invention, a first link is mechanically secured to a second link simply through the cooperation between the first link, the second link and an ornamental element.

In other words, as well as having an ornamental role, the ornamental element also plays a predominant role in mechanically securing the first link to the second link, since it is the ornamental element that holds the assembly head of the first link in the internal space of the second link through the assembly slot thereof, simply by setting the ornamental element in the internal space of the cradle of the second link.

Other particularly simple and convenient features of the link chain according to the invention are described hereinbelow.

Each cradle has a rear wall at the first end thereof, a front wall at the second end thereof and which is opposite the rear wall, and two side walls facing one another and each joining the rear wall and the front wall at the first and second ends, with the assembly slot being formed in the rear wall, the assembly head that projects from the front wall and the internal space which is delimited between the rear wall, the front wall and the side walls.

Each cradle has an upper insertion opening for inserting the ornamental element into the internal space, and a lower assembly opening, opposite the upper insertion opening, for passing the assembly head through the assembly slot.

Each assembly head is provided with a peg projecting from the cradle and an abutment member formed at a free end of the peg.

Each assembly head is provided with a recess formed in the peg upstream of the abutment member.

The cradle of the at least one second link rests on the recess formed in the peg of the assembly head of the at least one first link when the latter is assembled with the at least one second link.

When the at least one first link is assembled with the at least one second link and with the ornamental element, the latter rests on the abutment member of the assembly head of the at least one first link.

Each cradle has at least one guide member formed in the internal space and in the immediate vicinity of the assembly slot.

When the at least one first link is assembled with the at least one second link and with the ornamental element, the peg of the assembly head of the at least one first link is slid against the at least one guide member formed in the internal space and the abutment member thereof rests on the at least one guide member of the cradle.

The ornamental element of the second link includes a lug configured to be inserted into the internal space of the cradle so as to form an abutment for retaining the assembly head of the first link, and a plate for covering the cradle overlaying the lug.

According to a second aspect, the invention further relates to an article of jewellery and/or gemstone jewellery, comprising a link chain as described hereinabove, in particular to form a fringe of the article.

According to a third aspect, the invention further relates to a method for manufacturing a link chain as described hereinabove, in particular to form a fringe of an article of jewellery and/or gemstone jewellery, which method includes the steps of:

providing at least one first link and at least one second link, each including a cradle configured to receive the ornamental element in an internal receiving space of the cradle and including an assembly slot formed at a first end of the cradle and leading into the internal space, and an assembly head extending such that it projects from a second end of the cradle, opposite the first end thereof, and outside the internal space of the cradle;

providing at least one ornamental element;

inserting the head of the at least one first link into the internal space of the cradle of the at least one second link through the assembly slot thereof;

inserting the ornamental element into the internal space of the cradle of the at least one second link facing, in particular in the immediate vicinity of, the assembly head of the at least one first link and setting the ornamental element in the internal space of the cradle of the at least one second link.

BRIEF DESCRIPTION OF THE FIGURES

The invention, according to one example embodiment, will be better understood and the advantages thereof will become clearer on reading the following detailed description, which is given for purposes of illustration only and is not intended to limit the scope of the invention, with reference to the accompanying drawings.

DETAILED DESCRIPTION

Figure 1:
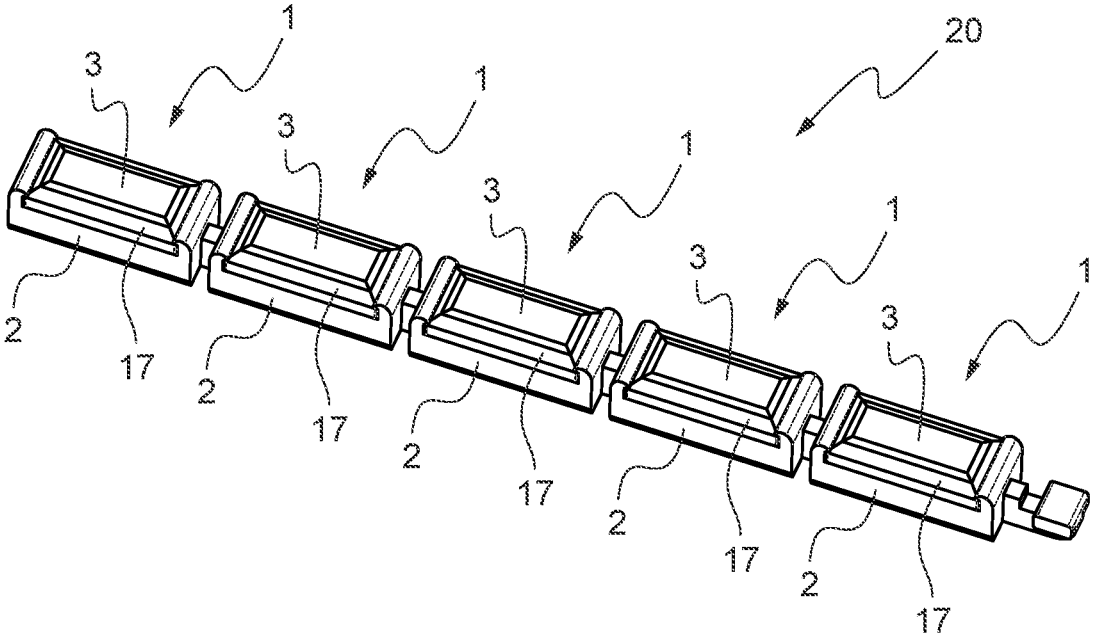
FIG. 1 diagrammatically illustrates a perspective view, taken from above, of a link chain according to the invention, forming a fringe of an article of jewellery and/or gemstone jewellery.
Figure 2:
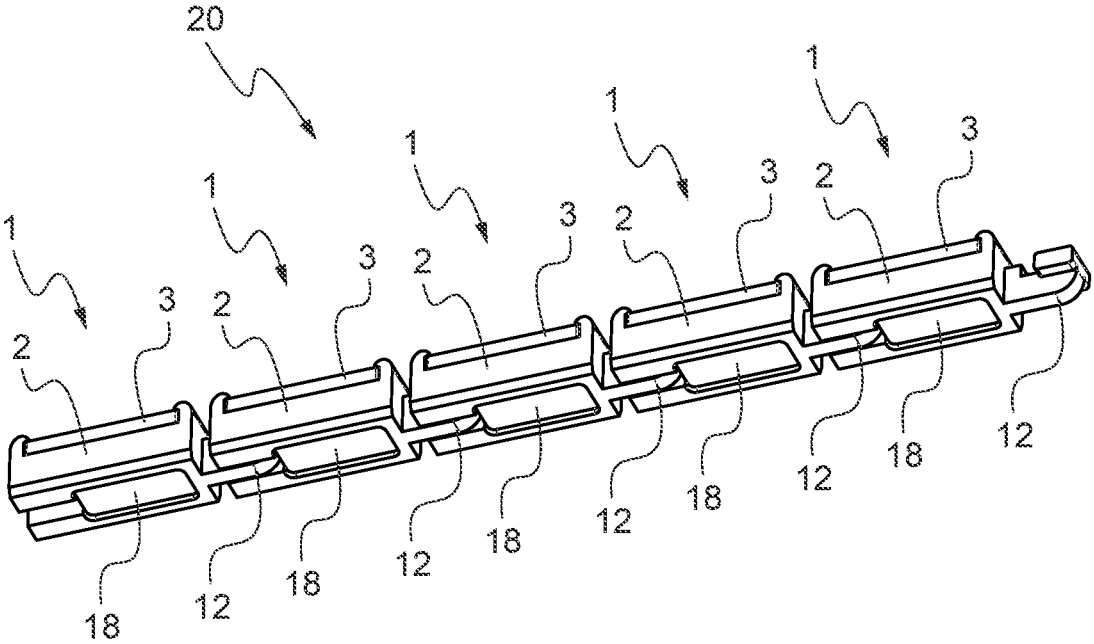
FIG. 2 is a perspective view, taken from below in this case, of the link chain in FIG. 1.

FIGS. 1 and 2 show a link chain 20, in particular of an article of jewellery and/or gemstone jewellery.

The link chain 20 comprises a plurality of links 1 assembled and secured together.

The links 1 are, in this case, aligned and form a substantially rectilinear and relatively rigid link chain 20.

Each of the links 1 of the link chain 20 comprises a cradle 2 including a first end and a second end opposite the first end.

Each link 1, which is, for example, referred to as a first link, is configured so that it can be assembled, or coupled, by the first end of its cradle 2 to another link 1, which is, for example, referred to as a second link, by the second end of its cradle 2.

The cradle 2 of each link 1 comprises an assembly head 12 configured to be inserted into the cradle 2 of another adjacent link 1.

Each link 1 further comprises an ornamental element 3, provided with a lug 18 and a cover plate 17 and set onto the cradle 2.

In the link chain 20, each ornamental element 3, except for one at one end of the link chain, is configured to act as a locking element locking the assembly of two links together.

Figure 3:
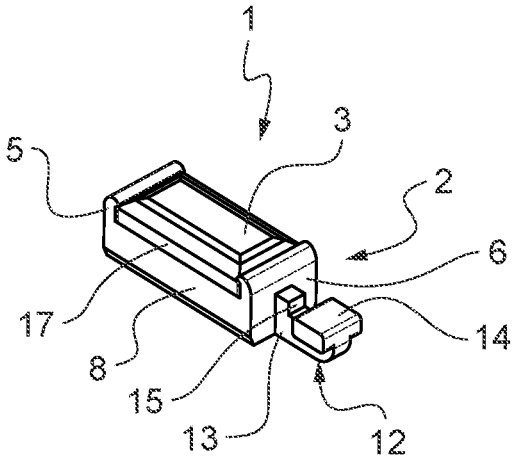
FIG. 3 is a perspective view of a link of the link chain in FIGS. 1 and 2, taken separately.
Figure 4:
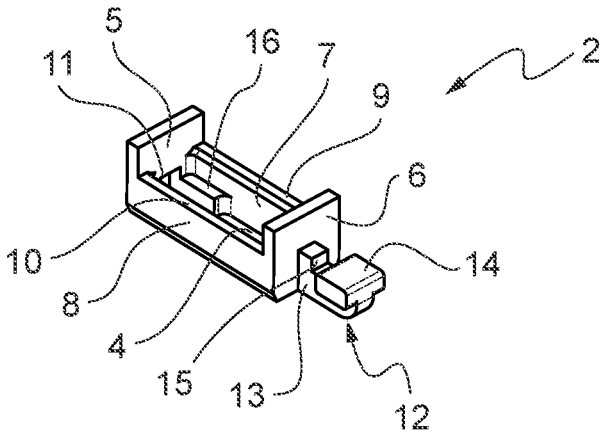
FIG. 4 is a perspective view of a cradle of the link in FIG. 3.
Figure 5:
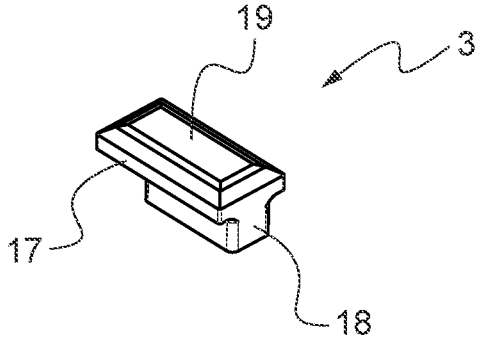
FIG. 5 is a perspective view of an ornamental element of the link in FIG. 3.

FIGS. 3 to 5 show one of the links 1 of the link chain 20 in more detail.

The cradle 2 includes a rear wall 5 at a first end, a front wall 6 at a second end opposite the first end, and two side walls 7 and 8 joining the rear wall 5 and the front wall 6 respectively.

The front wall 6 faces the rear wall 5, and the two side walls 7 and 8 face one another.

The cradle 2 further includes an internal receiving space 4 delimited by the rear wall 5, the front wall 6 and the two side walls 7 and 8.

The front, rear and side walls delimit an upper opening for inserting an ornamental element 3, and a lower assembly opening to allow an assembly head 12 to pass therethrough.

The upper insertion opening and the lower assembly opening are located at least partially facing one another and lead into the internal receiving space 4.

A dimension in a front-to-back direction will be referred to hereinbelow as the length and a dimension in a lateral direction will be referred to hereinbelow as the width. A dimension in a third direction orthogonal to the first two directions will be referred to as the height.

The front, rear and/or side walls can be substantially rectangular in shape.

The front, rear and/or side walls can be arranged substantially at right angles, with the cradle being substantially parallelepipedal in shape.

The rear wall 5 and the front wall 6 are higher than the side walls 7 and 8 and project beyond the upper opening.

The side walls 7 and 8 have edges 9 and 10 at the upper opening, which edges define bearing regions for the ornamental element 3, between the rear wall 5 and the front wall 6.

The cradle 2 comprises an assembly slot 11 formed in the rear wall 5.

The slot 11 passes through the rear wall 5 and in this case leads into the internal space 4 and into the lower opening.

The cradle 2 comprises an assembly head 12 extending such that it projects from the front wall 6, from an outer face of the front wall 6 and outside the internal space 4.

The assembly head 12 in this case extends such that it projects substantially at right angles from the front wall 6.

The assembly head 12 comprises a peg 13 projecting from the front wall 6 and an abutment member 14 at a free end of the peg 13.

For example, the peg 13 in this case extends from a region of the front wall 6 at the lower opening, to approximately halfway along a height of the front wall 6, and the peg 13 has, for example, a width that substantially matches a width of the slot 11.

The abutment member 14 is disposed on an upper face of the peg 13.

For example, the abutment member 14 is, in this case, located substantially facing and halfway along the height of the front wall 6.

In the example shown, the abutment member 14 is wider than the peg 13 on which it is formed.

However, in the example shown, the abutment member 14 is substantially narrower than the lower opening in the cradle 2, i.e. the width thereof is, in this case, less than a distance separating the side walls 7 and 8.

The peg 13 is, in this case, provided with a recess 15 formed upstream of the abutment member 14.

The cross-section of the peg 13 at the recess 15 can be complementary to the shape of the slot 11. When the slot 11 is substantially rectangular, the cross-section of the peg 13 at the recess 15 is substantially rectangular.

The recess 15 is formed at a distance from the front wall 6 and can extend as far as the abutment member 14.

As can be seen below, the distance of the recess 15 from the front wall 6 defines the spacing between the front wall 6 of one cradle 2 and the rear wall 5 of another adjacent cradle 2 when the two cradles 2 are assembled together.

The cradle 2 further comprises an internal guide member 16.

The guide member 16 is, in this case, formed by an extra thickness on each of the side walls 7 and 8.

The extra thickness extends over a limited portion of the side walls 7 and 8, in the immediate vicinity of the slot 11.

For example, the extra thickness extends over about one third to one half of a width of a side wall 7 and 8.

The extra thickness further extends over about half a height of a side wall 7 and 8.

The cover plate 17 of the ornamental element 3 is substantially rectangular, with a width that substantially matches the width of the cradle 2, and a length that substantially matches a distance between respective inner faces of the front wall 6 and rear wall 5 of the cradle 2.

The cover plate 17 overlies the lug 18, which thus projects from a lower face of the cover plate 17.

The lug 18 is, for example, formed by a substantially rectangular, parallelepipedal block.

The height of the lug 18 is such that the total height of the ornamental element 3 is, in this case, less than or equal to the height of the cradle 2.

The width of the lug 18 substantially matches the distance between the side walls 7 and 8 of the cradle 2, i.e. it substantially matches the width of the lower opening.

The length of the lug 18 substantially matches the length of the lower opening reduced by the length of the guide member 16.

The ornamental element 3 can further comprise one or more raised elements 19 at an upper face of the cover plate 17.

For example, when the ornamental element 3 is a precious or semi-precious stone, the upper face of the cover plate 17 can be cut to reveal decorative raised elements 19.

The cradle 2 and the ornamental element 3 can each be made in one piece.

The cradle 2 can, for example, be made of a metal material, for example a precious material such as gold, silver or platinum.

The ornamental element 3 can be made from a semi-precious or precious stone, such as spinel, diamond, or ruby, etc. or from mother-of-pearl, glass, or a precious metal, etc.

The manner of assembling two links 1, i.e. the linking of a first link with a second link, will now be described with reference to FIGS. 6 to 11, which show several steps of this assembly.

Figure 6:
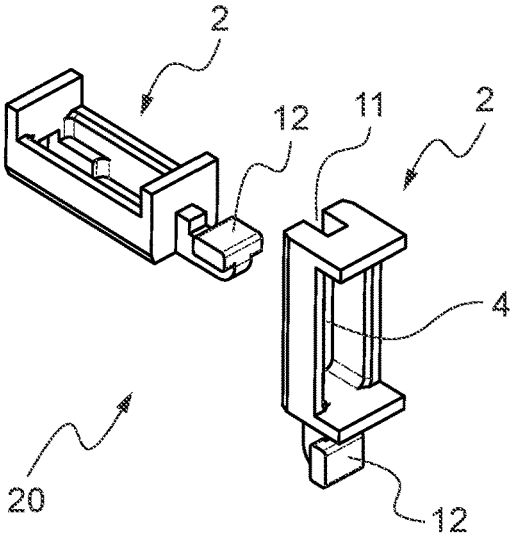
FIG. 6 diagrammatically illustrates a perspective view of the link chain formed by a first link and a second link such as those shown in FIGS. 3 to 5, according to a first assembly step.

In FIG. 6, the first link and the second link are arranged such that the cradles 2 are positioned substantially at right angles to one another, with the first end of the cradle 2 of the first link opposite the second end of the cradle 2 of the second link.

In particular, the assembly head 12 of the first link is disposed facing the lower opening in the cradle 2 of the second link.

Figure 7:
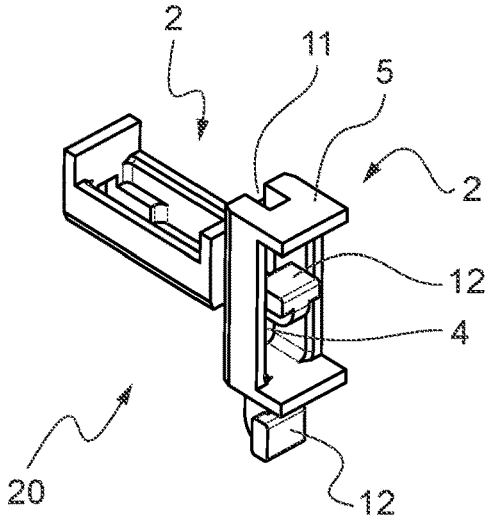
FIG. 7 diagrammatically illustrates a perspective view of the link chain formed by a first link and a second link such as those shown in FIGS. 3 to 5, according to a second assembly step.

In FIG. 7, the assembly head 12 of the first link is inserted through the lower opening into the internal space 4 of the cradle 2 of the second link.

Figure 8:
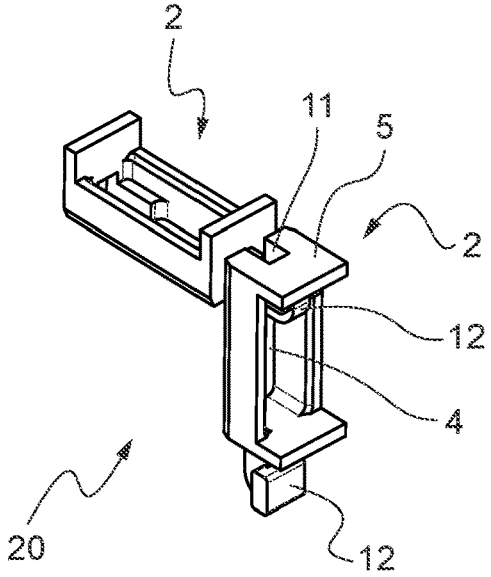
FIG. 8 diagrammatically illustrates a perspective view of the link chain formed by a first link and a second link such as those shown in FIGS. 3 to 5, according to a third assembly step.

In FIG. 8, the cradle 2 of the first link is moved in translation such that the assembly head 12 thereof is brought closer to the rear wall 5 of the cradle 2 of the second link.

In this position, the peg of the assembly head is at least partially guided between the guide member in the cradle.

Figure 9:
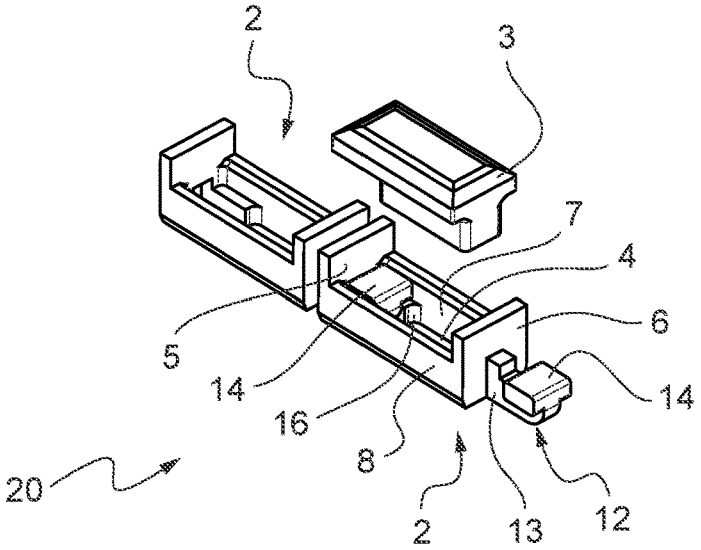
FIG. 9 diagrammatically illustrates a perspective view of the link chain formed by a first link and a second link such as those shown in FIGS. 3 to 5, according to a fourth assembly step.

In FIG. 9, the cradle 2 of the first link is moved in rotation such that the front wall 6 of the cradle 2 of the first link faces the rear wall 5 of the cradle 2 of the second link.

In this position, the lower face of the abutment member 14 of the assembly head 12 of the cradle 2 of the first link rests on the guide member 16, and the peg 13 is housed between the guide member 16 and in the slot 11 in the cradle 2 of the second link.

The cradle 2 of the second link rests on the peg 13 of the assembly head 12 of the first link, with, for example, the bottom of the slot 11 in the cradle 2 of the second link coming substantially into contact with the bottom of the recess 15 in the peg 13 of the assembly head 12 of the first link.

A part of the internal space 4 of the cradle 2 of the second link is thus occupied by the assembly head 12 of the cradle 2 of the first link.

This restricts relative motion of the cradles 2 of the first and second links in the vertical direction of the cradles 2.

This also restricts relative motion of the cradles 2 of the first and second links in the lateral direction and in the lateral direction of the cradles 2.

In FIG. 9, the ornamental element 3 of the second link is also brought closer to the cradle 2 of this second link and, in particular, the ornamental element 3 is intended to face and be in the immediate vicinity of, but not necessarily in direct contact with, the abutment member 14 of the assembly head 12 of the cradle 2 of the first link.

Figure 10:
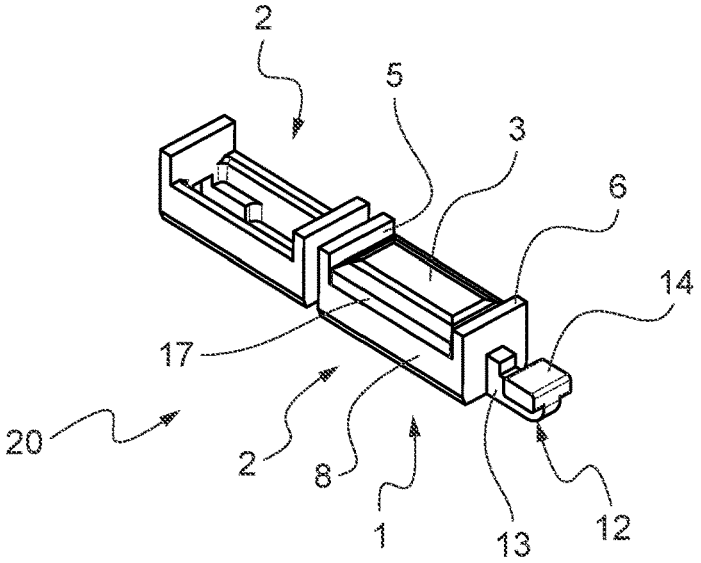
FIG. 10 diagrammatically illustrates a perspective view of the two assembled links, before the ornamental element has been set.

In FIG. 10, the ornamental element 3 of the second link is inserted through the upper opening into the internal space of the cradle 2 of the second link, with a portion of the lower face of the cover plate 17 facing and in the immediate vicinity of an upper face of the abutment member 14 of the assembly head 12 of the cradle 2 of the first link 1, another portion of the lower face of the cover plate 17 bearing against the bearing regions formed by the upper edges 9 and 10 of the side walls 7 and 8, and the lug 18 of the ornamental element 3 of the second link occupying part of the internal space 4 of the cradle 2 of this second link, which part is not already occupied by the assembly head 12 of the cradle 2 of the first link.

The cover plate 17 of the ornamental element 3 of the second link 1 is thus disposed between the rear wall 5 and the front wall 6 of the cradle 2 of the second link 1. In this case, it does not protrude laterally from the side walls 7 and 8.

The lug 18 of the ornamental element 3 of the second link forms an abutment against the assembly head 12 of the cradle 2 of the first link, which prevents the first link 1 and the second link 1 from moving relative to one another in the axial direction.

Figure 11:
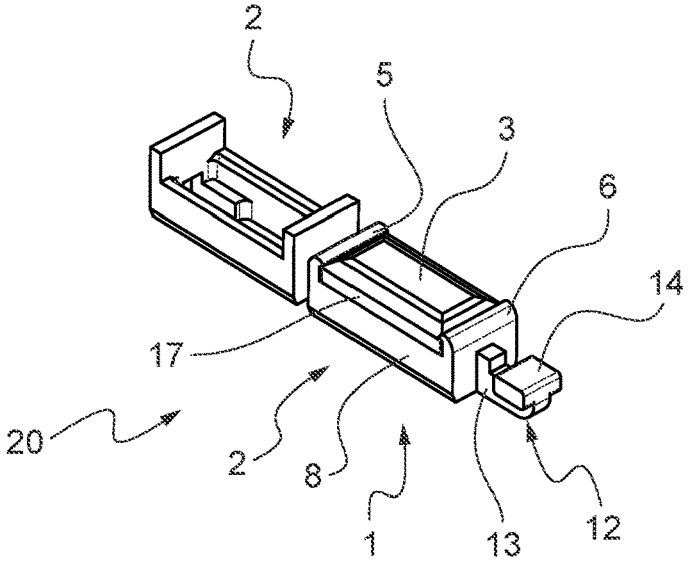
FIG. 11 diagrammatically illustrates a perspective view of the two assembled links, after the ornamental element has been set.

In FIG. 11, the ornamental element 3 of the second link is set in the cradle 2 of this second link.

In particular, in the example shown, the front and rear walls 6 and 5 of the cradle 2 of the second link have upper rims which are deformed and folded over the cover plate 17 of the ornamental element 3 of the second link to hold it in position.

The above description of the assembling of two links can thus be repeated for assembling other links, for example to obtain the link chain in FIGS. 1 and 2 and in particular, in this case, to form a fringe of an article of jewellery and/or gemstone jewellery, in particular of the pendant type or any other article.

This could, for example, be a necklace, a plastron necklace, a cuff-bracelet, or a wrist bracelet, etc.

It should be noted that a link chain as described hereinabove is particularly simple and convenient to achieve.

More generally, it should be noted that the invention is not limited to the examples described and illustrated.

The invention claimed is:

1. A link chain for an article of jewelry and/or gemstone jewelry, the link chain comprising:

at least one first link; and at least one second link mechanically secured to the at least one first link, wherein each of the at least one first link and at least one second link includes an ornamental element, and a cradle configured to receive the ornamental element in an internal receiving space of the cradle, the cradle including an assembly slot defined at a first end of the cradle and leading into the internal receiving space, and an assembly head extending such that the assembly head projects from a second end of the cradle, opposite the first end thereof, and outside the internal receiving space of the cradle, wherein the link chain is formed by the at least partial insertion of the assembly head of the at least one first link into the internal receiving space of the cradle of the at least one second link through the assembly slot thereof, the ornamental element that faces the assembly head of the at least one first link is disposed in the internal receiving space of the cradle of the at least one second link, and the at least one first link and the at least one second link are mechanically secured through a cooperation between the at least one first link, the at least one second link, and the ornamental element, the ornamental element holding the assembly head of the at least one first link in the internal receiving space of the at least one second link through the assembly slot of the at least one second link.

2. The link chain according to claim 1, wherein each cradle has a rear wall at the first end thereof, a front wall at the second end thereof and which is opposite the rear wall, and two side walls facing one another and each joining the rear wall and the front wall at the first and second ends, wherein the assembly slot is defined in the rear wall, the assembly head, and the internal receiving space which is delimited between the rear wall, the front wall, and the side walls.

3. The link chain according to claim 2, wherein each of the cradles has an upper insertion opening configured to receive the ornamental element into the internal receiving space, and a lower assembly opening, opposite the upper insertion opening, configured to receive the assembly head through the assembly slot.

4. The link chain according to claim 2, wherein each of the assembly heads is provided with a peg projecting from the cradle and an abutment member formed at a free end of the peg.

5. The link chain according to claim 1, wherein each of the cradles has an upper insertion opening configured to receive the ornamental element into the internal receiving space, and a lower assembly opening, opposite the upper insertion opening, configured to receive the assembly head through the assembly slot.

6. The link chain according to claim 5, wherein each of the assembly heads is provided with a peg projecting from the cradle and an abutment member formed at a free end of the peg.

7. An article of jewelry and/or gemstone jewelry comprising:

the link chain according to claim 1, to form a fringe of the article.

8. A method for manufacturing the link chain according to claim 1, to form a fringe of the article of jewelry and/or gemstone jewelry, the method comprising:

providing the at least one first link and the at least one second link, each including the cradle configured to receive the ornamental element in the internal receiving space of the cradle, the cradle including the assembly slot formed at the first end of the cradle and leading into the internal receiving space, and the assembly head extending such that the assembly head projects from a second end of the cradle, opposite the first end thereof, and outside the internal receiving space of the cradle;

inserting the head of the at least one first link into the internal receiving space of the cradle of the at least one second link through the assembly slot thereof;

providing the ornamental element; and inserting the ornamental element into the internal receiving space of the cradle of the at least one second link facing the assembly head of the at least one first link and setting the ornamental element in the internal receiving space of the cradle of the at least one second link.

9. A link chain for an article of jewelry and/or gemstone jewelry, the link chain comprising:

at least one first link; and at least one second link mechanically secured to the at least one first link, wherein each of the at least one first link and at least one second link includes an ornamental element, and a cradle configured to receive the ornamental element in an internal receiving space of the cradle, the cradle including an assembly slot defined at a first end of the cradle and leading into the internal receiving space, and an assembly head extending such that the assembly head projects from a second end of the cradle, opposite the first end thereof, and outside the internal receiving space of the cradle, wherein the link chain is formed by the at least partial insertion of the assembly head of the at least one first link into the internal receiving space of the cradle of the at least one second link through the assembly slot thereof, the ornamental element that faces the assembly head of the at least one first link is disposed in the internal receiving space of the cradle of the at least one second link, each of the assembly heads is provided with a peg projecting from the cradle and an abutment member formed at a free end of the peg, and when the at least one first link is assembled with the at least one second link and the ornamental element, the ornamental element rests on the abutment member of the assembly head of the at least one first link.

10. The link chain according to claim 9, wherein each of the assembly heads is provided with a recess formed in the peg upstream of the abutment member.

11. The link chain according to claim 10, wherein, when the at least one first link is assembled with the at least one second link and the ornamental element, the ornamental element rests on the abutment member of the assembly head of the at least one first link.

12. The link chain according to claim 10, wherein each of the cradles has at least one guide member disposed in the internal receiving space and in the immediate vicinity of the assembly slot.

13. The link chain according to claim 10, wherein the cradle of the at least one second link rests on the recess formed in the peg of the assembly head of the at least one first link when the at least one second link is assembled with the at least one first link.

14. The link chain according to claim 13, wherein, when the at least one first link is assembled with the at least one second link and the ornamental element, the ornamental element rests on the abutment member of the assembly head of the at least one first link.

15. The link chain according to claim 13, wherein each of the cradles has at least one guide member disposed in the internal receiving space and in the immediate vicinity of the assembly slot.

16. The link chain according to claim 9, wherein each of the cradles has at least one guide member disposed in the internal receiving space and in the immediate vicinity of the assembly slot.

17. The link chain according to claim 16, wherein, when the at least one first link is assembled with the at least one second link and the ornamental element, the peg of the assembly head of the at least one first link is slid against the at least one guide member formed in the internal receiving space and the abutment member thereof rests on the at least one guide member of the cradle.

18. An article of jewelry and/or gemstone jewelry comprising:

the link chain according to claim 9, to form a fringe of the article.

19. A link chain for an article of jewelry and/or gemstone jewelry, the link chain comprising:

at least one first link; and at least one second link mechanically secured to the at least one first link, wherein each of the at least one first link and at least one second link includes an ornamental element, and a cradle configured to receive the ornamental element in an internal receiving space of the cradle, the cradle including an assembly slot defined at a first end of the cradle and leading into the internal receiving space, and an assembly head extending such that the assembly head projects from a second end of the cradle, opposite the first end thereof, and outside the internal receiving space of the cradle, wherein the link chain is formed by the at least partial insertion of the assembly head of the at least one first link into the internal receiving space of the cradle of the at least one second link through the assembly slot thereof, the ornamental element that faces the assembly head of the at least one first link is disposed in the internal receiving space of the cradle of the at least one second link, and the ornamental element of the second link includes a lug configured to be inserted into the internal receiving space of the cradle to form an abutment to retain the assembly head of the first link, and a plate configured to cover the cradle overlaying the lug.

20. An article of jewelry and/or gemstone jewelry comprising:

the link chain according to claim 19, to form a fringe of the article.

* * * * *